US005775689A

United States Patent [19]

Moser et al.

[11] Patent Number: 5,775,689

[45] Date of Patent: Jul. 7, 1998

[54] ACCUMULATOR APPARATUS AND METHOD

[75] Inventors: James R. Moser; Donald Dudash, both of Easton; Richard W. Finnochio, Saylorsburg; Frank S. Lusk, Walnutport, all of Pa.

[73] Assignee: Bell & Howell Mail Processing Systems, Durham, N.C.

[21] Appl. No.: 755,001

[22] Filed: Nov. 22, 1996

[51] Int. Cl.[6] ..... B65H 43/04

[52] U.S. Cl. ..... 271/198; 271/207; 271/213; 271/272; 414/790.7

[58] Field of Search ..... 271/198, 202, 271/213, 242, 272, 207; 414/789.9, 790.7, 790.8, 794.4

[56] References Cited

U.S. PATENT DOCUMENTS

| | | | |
|---|---|---|---|
| 3,336,028 | 8/1967 | Schonmeier | 271/202 |
| 3,502,321 | 3/1970 | McWhorter | 271/202 |
| 4,516,759 | 5/1985 | Kobler | 271/202 |
| 4,799,663 | 1/1989 | Goliez | 271/213 |
| 5,083,769 | 1/1992 | Young | 271/198 |
| 5,123,639 | 6/1992 | Edwards | 271/198 |
| 5,147,092 | 9/1992 | Driscoll et al. | 271/198 |
| 5,178,379 | 1/1993 | Edwards et al. | 271/198 |
| 5,244,200 | 9/1993 | Manzke | 271/198 |
| 5,342,038 | 8/1994 | Suter | 414/790.7 |
| 5,433,431 | 7/1995 | Lowell | 271/198 |

*Primary Examiner*—H. Grant Skaggs
*Attorney, Agent, or Firm*—Jenkins & Wilson, P.A.

[57] ABSTRACT

An accumulator apparatus and method are provided for accumulating sheet articles. The accumulator apparatus includes an upper belt system and lower belt system operative for advancing sheet articles in seriatim manner therebetween. Guide rollers are provided at the entrance of the sheet articles between the upper and lower belt systems for guiding the sheet articles therebetween without pinching. Nip rollers are provided downstream from the entry guide rollers for pulling sheet articles into the accumulator apparatus between the guide rollers and the nip rollers. A ramp system operative for deflecting advancing sheet articles is provided downstream from the nip rollers. Sheet articles deflected by the ramp assembly can then be accumulated in an accumulation location where the lower belt system is maintained in a spaced-apart position below the accumulation location such that the lower belt system cannot contact or mark sheet articles accumulated therein. Stop rollers are provided for selectively stopping further advancement of accumulated sheet articles from the accumulation location and for pulling the accumulated sheet articles from the accumulation location to advance the sheet articles from the accumulator apparatus.

23 Claims, 8 Drawing Sheets

ACCUMULATOR APPARATUS AND METHOD

BACKGROUND OF THE INVENTION

1. Technical Field

The present invention relates generally to accumulator apparatuses and methods for accumulating sheet articles. More particularly, the present invention relates to an improved non-marking accumulator apparatus and method for over-accumulating sheet articles into stacks.

2. Background Art

Various accumulator apparatuses and methods have been employed in the past for accumulating sheet material or articles such as paper sheets, documents, and the like into stacks for subsequent advancement. Such accumulator apparatuses and methods have particular use in high-speed mail processing where preparation and processing of mailable articles often requires a plurality of sheet articles to be assembled into a packet for further handling which can include, for example, folding, inserting, collating, etc.

As an example, U.S. Pat. No. 5,244,200 to Manzke, commonly assigned herewith, discloses a retractable-ramp accumulator and method comprising driven endless elastic belts which feed sheets therebetween along a sheet-feeding path. A series of operatively connected and selectively retractable ramps are utilized for selectively deflecting sheets out of the sheet-feeding path for accumulating the sheets in a stack after they pass the ramps in a stacking location between the ramps and selectively releasable stop gates.

As illustrated in the example provided above, it is common for prior art accumulator apparatuses and methods to employ endless upper belts and lower belts for seriatim feeding of sheet articles therebetween. A problem exists though since even when the sheet articles are accumulated in a stack in a stacking location, the upper belts and the lower belts continue to engagably move past and against opposing sides of the stack of accumulated sheet articles. Only the utilization of some form of stop means prevents the accumulated sheet articles from being further advanced from their accumulation location. Since sheet articles processed through such accumulator apparatuses and methods can be printed with toner on one or even both sides thereof, the continuous contact and engagement by the upper belts and lower belts of processed sheet articles can cause toner thereon to smear whereby the upper belts and/or lower belts disadvantageously mark the processed sheet articles.

Such accumulator apparatuses and methods utilizing upper endless belts and lower endless belts for advancing sheet articles therebetween are often operatively attached downstream of a cutter apparatus for cutting the sheet articles prior to accumulating the sheet articles. In many cases, it is necessary to utilize a transport device or "cutter interface" of some type which is attached between the cutter apparatus and the accumulator apparatus. In these cases, the accumulator apparatus is attached to the cutter interface on an opposite side thereof from the cutter apparatus and typically utilizes upper and lower nip rollers at the entry location of the accumulator apparatus in order to pinch sheet articles advanced thereto and cause advancement of the sheet articles therebetween and into the accumulator apparatus. This type of pinching of the sheet articles coming from the cutter interface can also cause marking of processed sheet articles having toner thereon.

In light of the prior art accumulator apparatuses and methods as described hereinabove, there remains much room for improvement in the art for an accumulator apparatus and method which reduces or eliminates marking of sheet articles processed therethrough which have toner thereon and which eliminates in some applications the prior need for utilization of a cutter interface with the downstream connection of the accumulator apparatus with a cutter apparatus.

DISCLOSURE OF THE INVENTION

In accordance with the present invention, a novel accumulator apparatus and method are provided for accumulating and subsequently advancing sheet articles. The accumulator apparatus comprises a plurality of upper belt means and lower belt means operative for advancement of sheet articles in seriatim manner therebetween. Entry roller guide means is provided at the entrance of the sheet articles to the accumulator apparatus and between the upper belt means and the lower belt means for guiding sheet articles without pinching. Downstream from the entry roller guide means is nip roller means for pulling sheet articles in a horizontal feeding plane between the upper belt means and the lower belt means. Ramp means is provided downstream from the nip roller means for deflecting sheet articles out of the horizontal feeding plane. The accumulator apparatus further includes accumulating means for over-accumulating sheet articles deflected by the ramp means. The accumulating means comprises support means for supporting accumulated sheet articles such that the lower belt means does not contact the accumulated sheet articles and therefore cannot mark any of the accumulated sheet articles. Stop means is provided downstream from the accumulation location and is selectively operable to stop accumulated sheet articles from further advancement past the accumulation location and for alternately pulling the accumulated sheet articles from the accumulation location to advance the accumulated sheet articles.

It is therefore an object of the present invention to provide a novel accumulator apparatus and method for processing of sheet articles.

It is another object of the present invention to provide an accumulator apparatus and method which reduces or eliminates marking of sheet articles processed therethrough.

It is a further object of the present invention to provide an accumulator apparatus and method which in some applications eliminates the need for utilization of a cutter interface when the accumulator apparatus is operatively connected downstream of a cutter apparatus.

Some of the objects of the invention having been stated hereinabove, other objects will become evident as the description proceeds, when taken in connection with the accompanying drawings as best described hereinbelow.

DESCRIPTION OF THE DRAWINGS

FIG. 2(*c*) of the drawings is an isolated perspective view of the ramp means of the accumulator apparatus of FIG. 1;

BEST MODE FOR CARRYING OUT THE INVENTION

Figure 4:
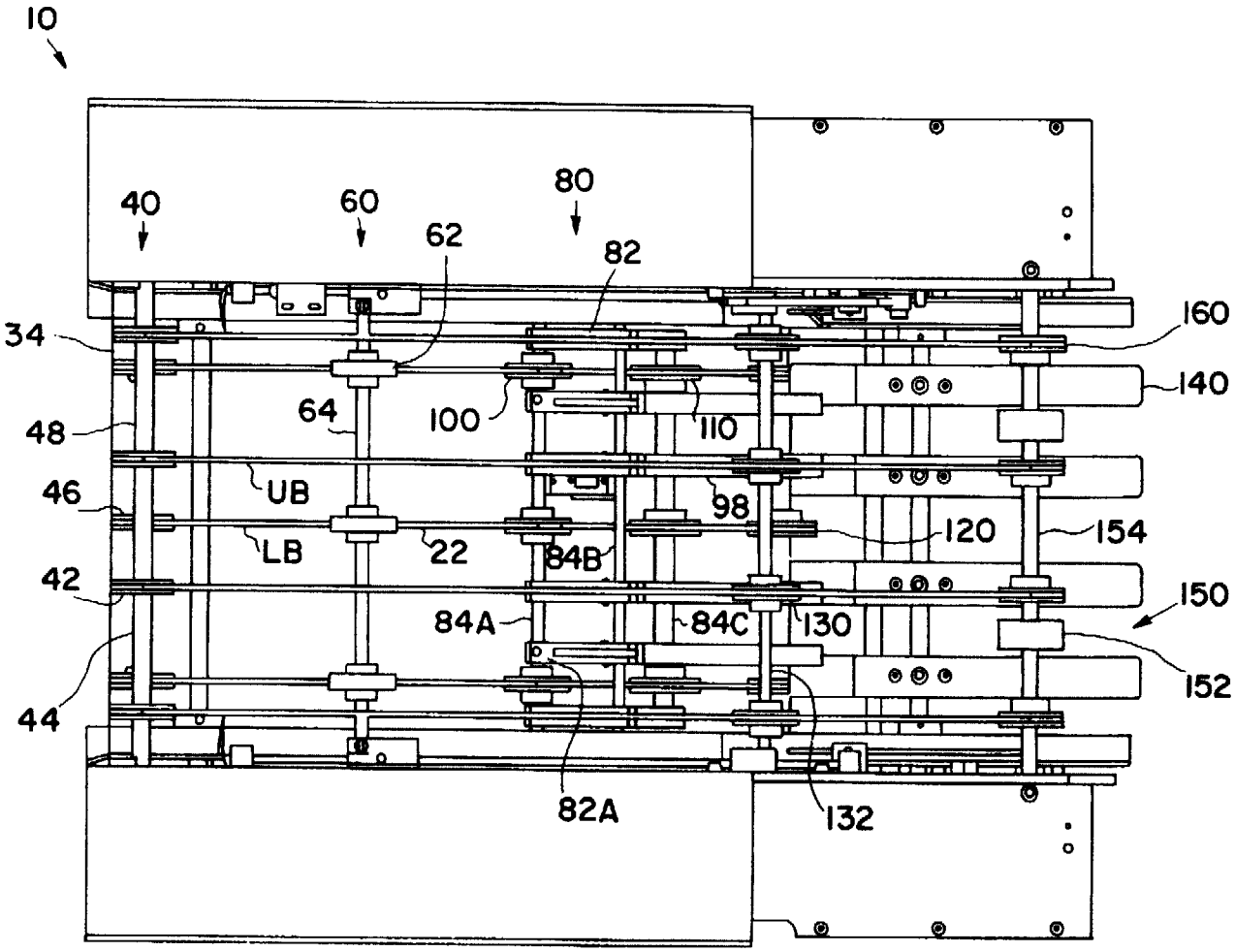
FIG. 4 of the drawings is a top plan view of a fully assembled embodiment of the accumulator apparatus of this invention.
Figure 5:
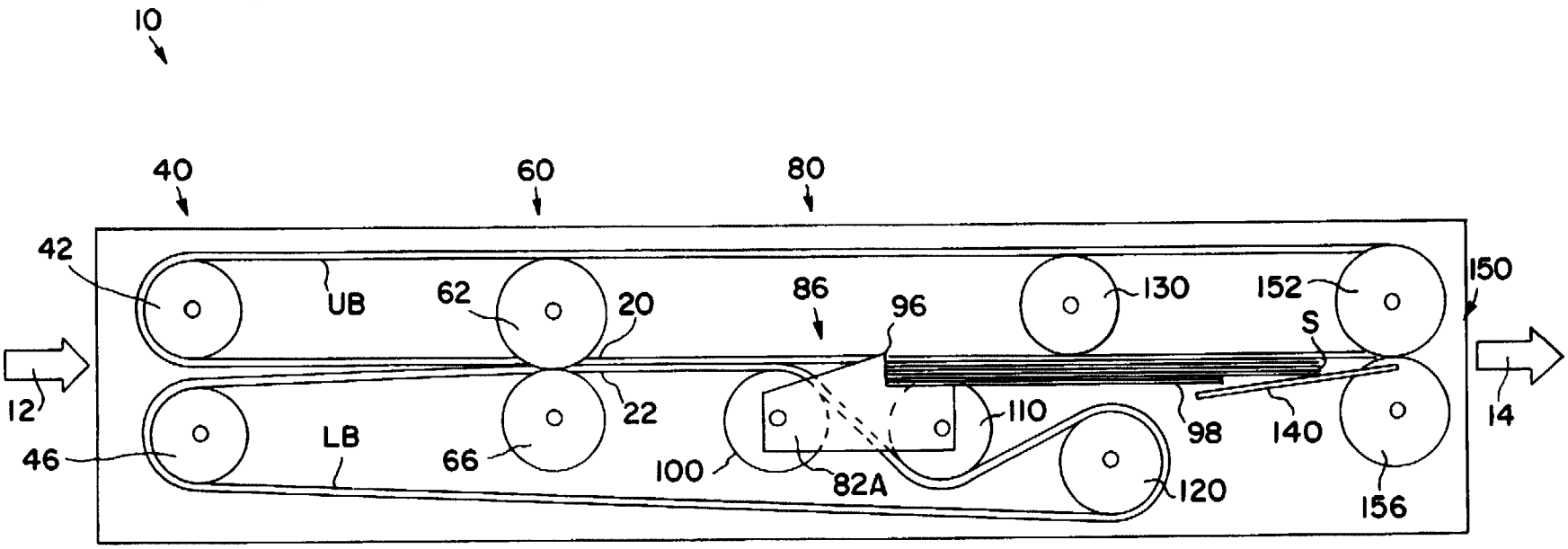
FIG. 5 of the drawings is the schematic side elevational view of the accumulator apparatus of FIG. 1.

In accordance with the present invention, an accumulator apparatus generally designated 10 is provided and comprises upper belt means and lower belt means adapted for advancement of sheet articles therebetween. The upper belt means comprises a plurality of spaced-apart belts illustrated in the preferred embodiment at least partially in FIGS. 1 and 4–8 as driven upper endless elastic polycord belts UB. Similarly, the lower belt means also comprises a plurality of spaced-apart belts illustrated in a preferred embodiment at least partially in FIGS. 1 and 4–8 as driven lower endless elastic polycord belts LB. Upper belts UB include lower reaches 20, and lower belts LB include upper reaches 22 as best illustrated in FIGS. 4 and 5 of the drawings. Upper belts UB and lower belts LB are driven, usually continuously, such that lower reaches 20 and upper reaches 22 move at substantially the same speed in a common direction in which sheet articles can be processed through accumulator apparatus 10 as indicated by entry arrow 12 and exit arrow 14 shown in FIG. 5. Any suitable conventional drive system can be utilized to drive upper belts UB and lower belts LB such as operative interconnection of shafts of rollers around which upper belts UB and lower belts LB extend and utilization of a clutch/brake system as shown. Lower reaches 20 of upper belts UB and upper reaches 22 of lower belts LB are substantially disposed in and thereby define a generally horizontal feeding plane for sheet articles processed through accumulator apparatus 10.

Figure 3:
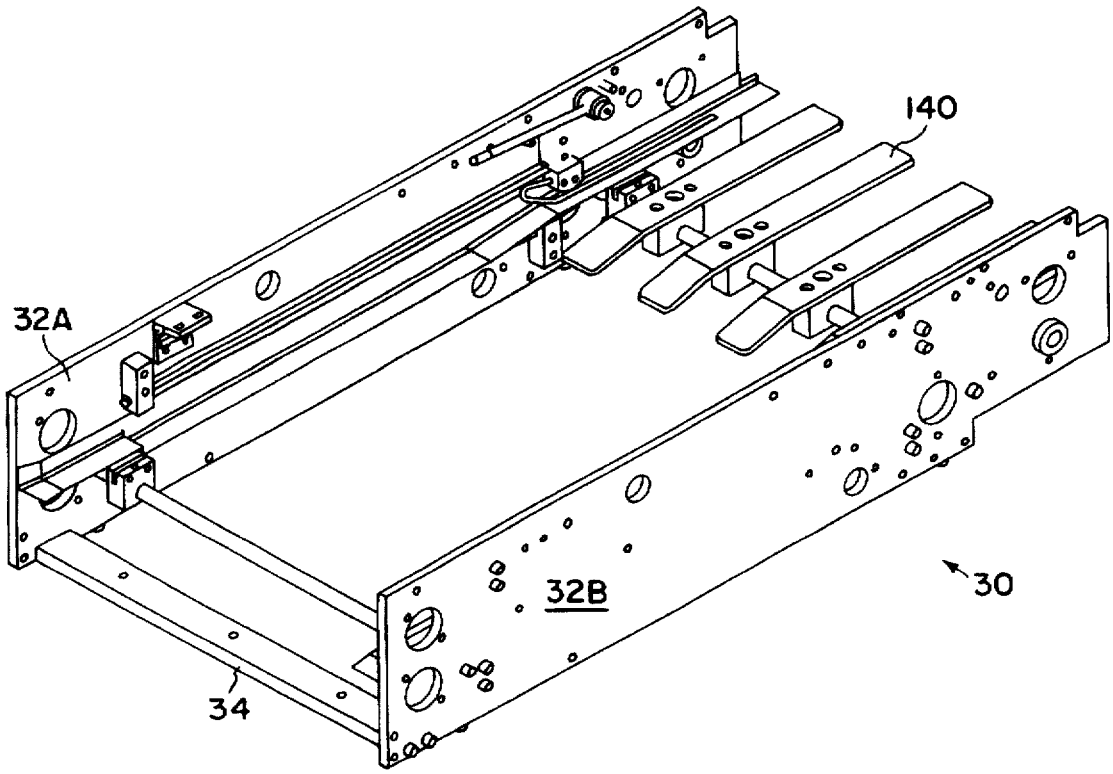
FIG. 3 of the drawings is a perspective view of a frame portion of the accumulator apparatus of FIG. 1.

Accumulator apparatus 10 is preferably modular in design so as to be easily interchangeable in line with other sheet article processing components. Accumulator apparatus 10 comprises a frame portion generally designated 30 and shown in one embodiment in FIG. 3 of the drawings. Frame portion 30 comprises a pair of parallel side plates 32A and 32B which are maintained in a spaced-apart relationship by one or more connecting members, such as, for example, connecting member 34 which can be a bar or a bottom plate for accumulator apparatus 10.

Figure 1:
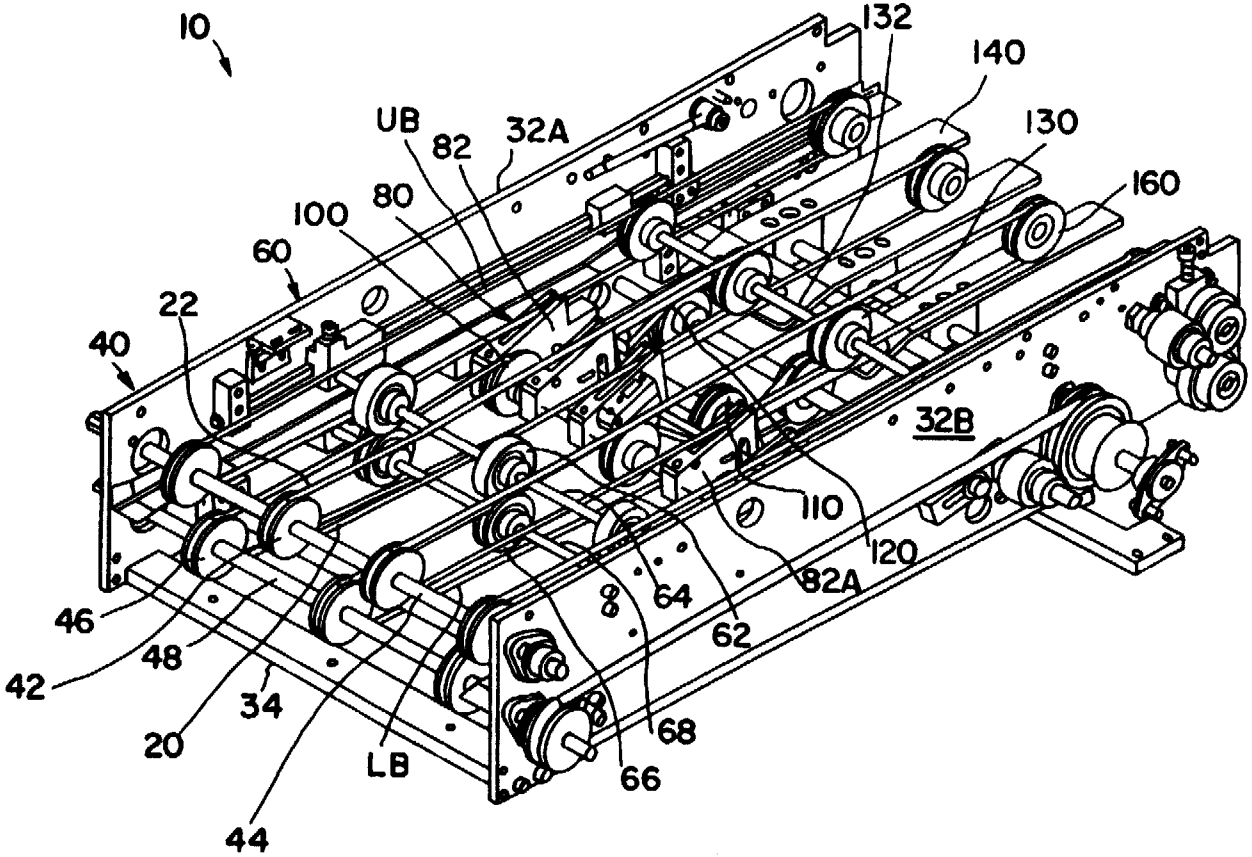
FIG. 1 of the drawings is a perspective view of an embodiment of the accumulator apparatus according to this invention without stop means thereon.

At the entry end of accumulator apparatus 10 where sheet articles can advance into accumulator apparatus 10 between upper belts UB and lower belts LB, entry roller guide means generally designated 40 is provided and comprises a plurality of upper guide rollers 42 fixedly attached in a spaced-apart relationship to shaft 44. Entry roller guide means 40 additionally comprises a plurality of lower guide rollers 46 fixedly attached in a spaced-apart relationship to shaft 48. Shafts 44 and 48 are fixedly but rotatably attached to and between side plates 32A and 32B. Upper belt means UB extends around upper guide rollers 42, and lower belt means LB extends around lower guide rollers 46 as shown in FIGS. 1 and 48 of the drawings.

In accordance with this invention, upper guide rollers 42 and lower guide rollers 46 are vertically spacedly positioned (but not aligned) such that a gap or space exists therebetween. In a preferred embodiment, a space of approximately ⅛ of an inch exists between the lowest portions of upper guide rollers 42 and the highest portions of lower guide rollers 46. Also in a preferred embodiment, upper guide rollers 42 and lower guide rollers 46 are positioned on shafts 44 and 48, respectively, in an alternating manner where they intentionally are not vertically aligned such that upper guide rollers 42 and lower guide rollers 46 cannot pinch together sheet articles positioned therebetween. In this manner, upper guide rollers 42 and lower guide rollers 46, in operative association with upper belts UB and lower belts LB, respectively, provide a guide for sheet articles advancing therebetween without pinching or marking the sheet articles.

Figure 6:
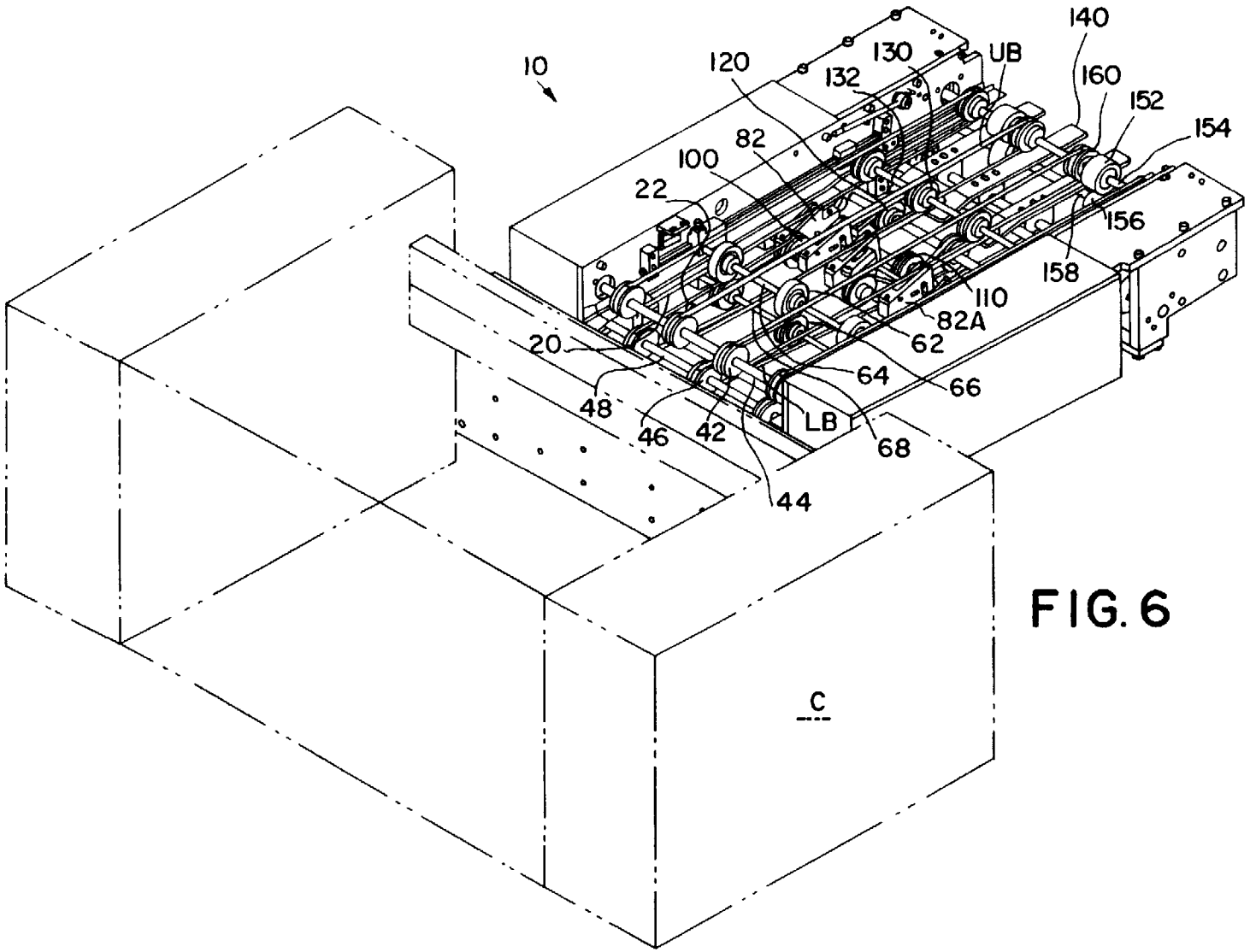
FIG. 6 of the drawings is front perspective view of the accumulator apparatus of FIG. 4 attached downstream of a cutter apparatus.
Figure 7:
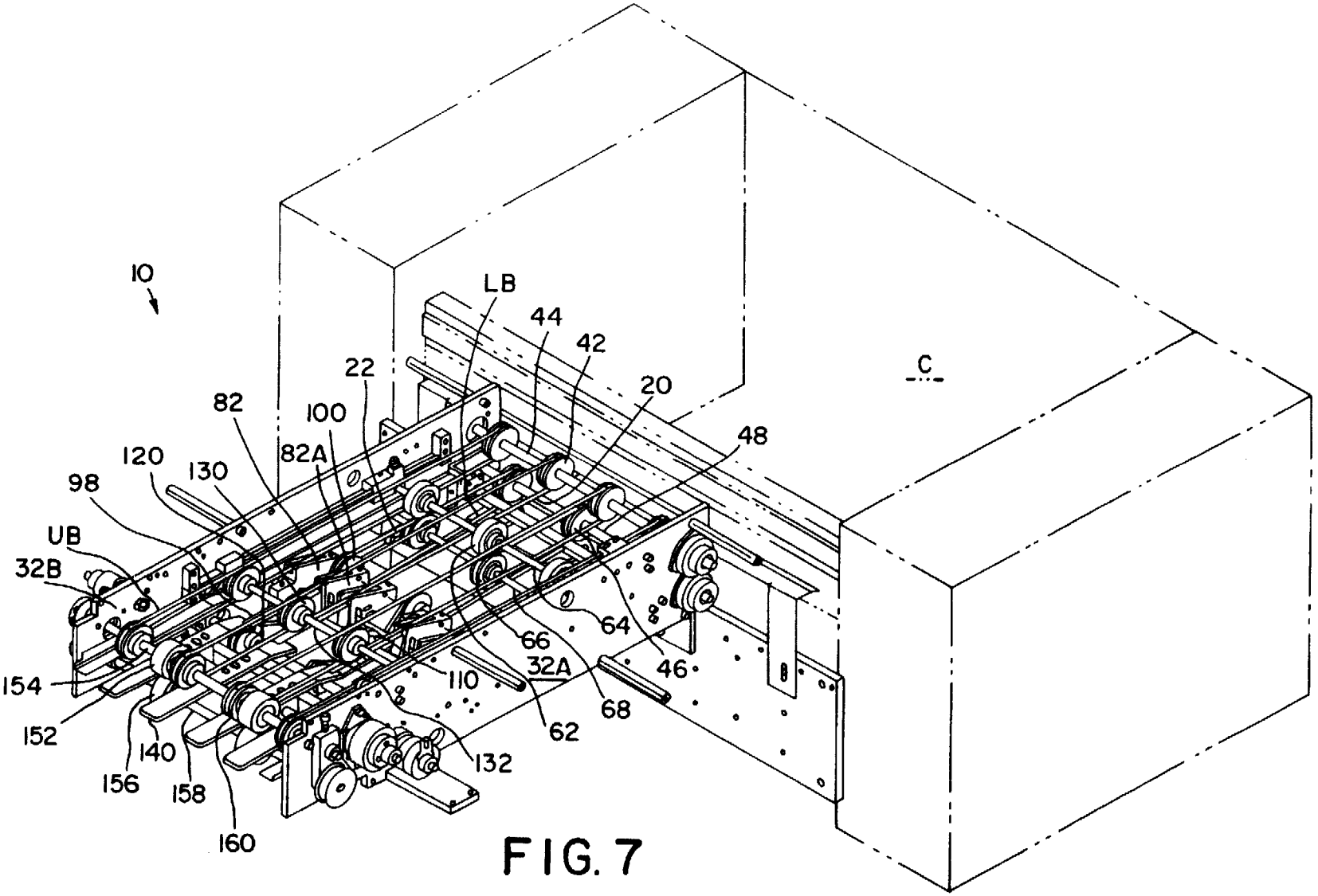
FIG. 7 of the drawings is a rear perspective view of the accumulator apparatus and cutter apparatus of FIG. 6 with side cover portions of the accumulator apparatus removed therefrom.

While it is envisioned that accumulator apparatus 10 can be operatively attached downstream of any suitable component for processing sheet articles, accumulator apparatus 10 has particularly advantageous application when directly attached downstream of a device such as a cutter apparatus C, as shown in FIGS. 6 and 7 of the drawings, without the use or need of a cutter interface. When so attached, sheet articles exiting cutter apparatus C can enter accumulator apparatus 10 and be guided thereinto by upper guide rollers 42 and lower guide rollers 46 without pinching of the entering sheet articles. As will be apparent to those of skill in the art, a cutter interface may still be necessary in certain circumstances such as, for example, with connection to Right Angle and Turnover Sequencer modules.

To pull the leading edge, which usually does not have toner thereon, of individual sheet articles guided by entry roller guide means 40 into accumulator apparatus 10 between upper belts UB and lower belts LB, entry nip roller means generally designated 60 is provided downstream from entry roller guide means 40 and in line with lower belts LB. When accumulator apparatus 10 is attached downstream of cutter apparatus C, entry nip roller means 60 can even engage the leading edge of a sheet article prior to cutting of the sheet article in cutter apparatus C. Entry nip roller means 60 comprises a plurality of upper entry nip rollers 62 attached in a spaced-apart relationship to shaft 64 and a plurality of lower entry nip rollers 66 attached in a spaced-apart relationship to shaft 68. Unlike entry roller guide means 40, upper entry nip rollers 62 and lower entry nip rollers 66 are adapted for pinching together whereby the leading edge of a sheet article can be pulled and advanced therebetween along the horizontal feeding plane of accumulator apparatus 10.

In a preferred embodiment, upper reaches 22 of lower belts LB extend between upper entry nip rollers 62 and lower entry nip rollers 66 such that entry nip roller means 60 is driven by lower belts LB. Upper entry nip rollers 62 can be rotatably attached to shaft 64, and it can therefore be understood that when a sheet article is positioned between upper entry nip rollers 62 and lower entry nip rollers 66 as lower belts LB (and upper belts UB) are moving to advance the sheet article, upper entry nip rollers 62 will idle without being forcibly drive. In this fashion, entry nip roller means 60 facilitates non-marking of sheet articles processed between upper entry nip rollers 62 and lower entry nip rollers 66 having toner thereon. As will be apparent to those of skill in the art, entry nip roller means 60 can be laterally adjustable to accommodate sheet articles of various lengths entering accumulator apparatus 10 by being pulled there unto by entry nip roller means 60.

Downstream from nip roller means 60, accumulator apparatus 10 comprises ramp means generally designated 80 for deflecting sheet articles processed between upper belt means UB and lower belt means LB from the horizontal feeding plane. As will be apparent to those of skill in the art of sheet material processing, ramp means 80 can include a plurality of suitable ramp members, such as side ramp members 82 and intermediate ramp members 82A, which can be fixedly positioned. Ramp members 82 and 82A can also be selectively retractable for selective diversion of processed sheet articles as will be recognized by those of skill in the art and additionally in accordance with the disclosure of U.S. Pat. No. 5,244,200 to Manzke, which is incorporated by reference herein.

Figure 2A:
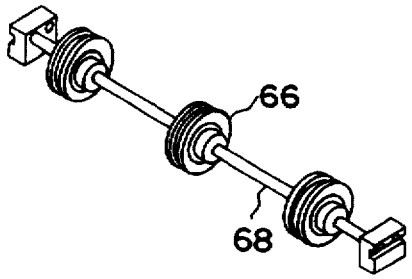
FIGS. 2(*a*) and 2(*b*) are isolated perspective views of upper and lower entry nip roller assemblies, respectively, of the accumulator apparatus of FIG. 1.
Figure 2B:
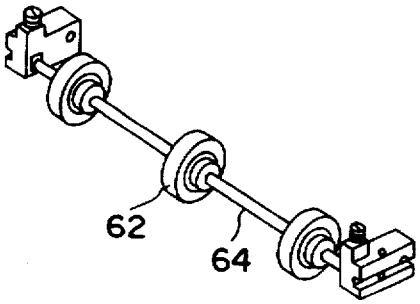
Figure 2C:
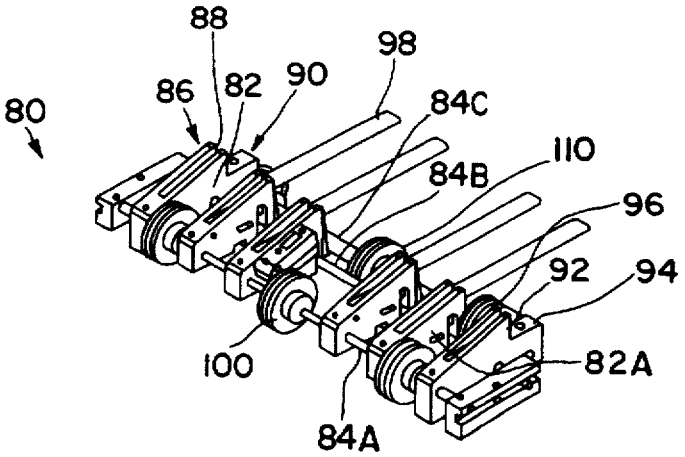
Figure 8:
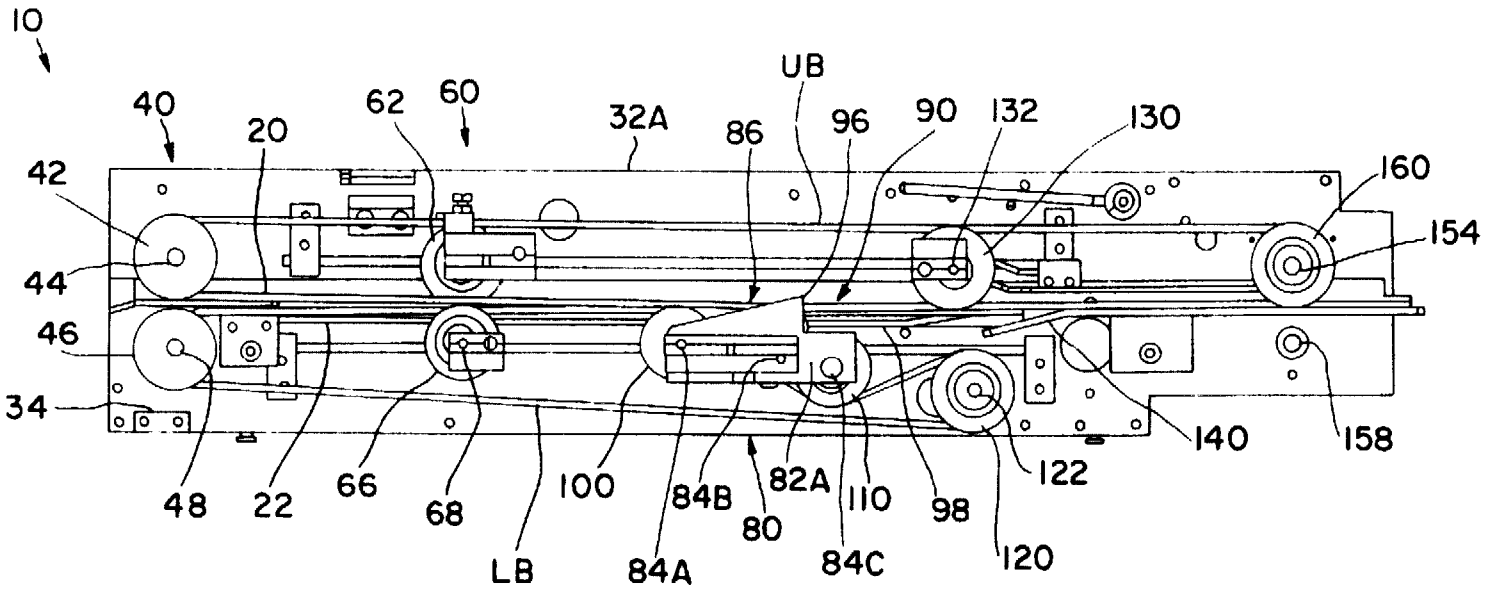
FIG. 8 of the drawings is a side elevational sectional view of the accumulator apparatus of this invention.

As shown in one embodiment and best shown in FIGS. 2C, 4 and 8, ramp members 82 and 82A are operatively interconnected by one or more shafts such as front shaft 84A, to which ramp members 82 and 82A can be fixedly or pivotably attached as described hereinabove, middle shaft 84B and rear shaft 84C. Referring particularly to FIG. 2C, ramp members 82 and 82A comprise deflecting surfaces generally designated 86 with slots 88 defined therein for extension therethrough of lower reaches 20 of upper belt UB. Deflecting surfaces 86 terminate on the upper ends thereof at upper edges 96. It is to be understood therefore that deflecting surfaces 86 and upper edges 96 of ramp members 82 and 82A extend in an interposed position across the horizontal feeding plane for sheet articles. Side ramp members 82 can define rear upper corners generally designated 90 formed by vertical edges 92 and horizontal surfaces 94.

Accumulator apparatus 10 further comprises a plurality of aligned front rollers 100 and rear rollers 110 which both can be in line with lower belts LB and can be separate from ramp means 80 or included as components thereof. As shown in a preferred embodiment in various of the figures of drawings, particularly FIG. 2(*c*) and 8, front rollers 100 are spacedly attached to front shaft 84A of ramp means 80 for engaging on the top sides thereof upper reaches 22 of lower belts LB. Rear rollers 110 are attached to rear shaft 84C of ramp means 80 between some of the ramp members thereon in such a manner as to be aligned in the feeding direction of sheet articles through accumulator apparatus 10.

According to a novel aspect of this invention, upper reaches 22 of lower belts LB extend over and engage front rollers 100 and extend from such above-engaging position with front rollers 100 downwardly and away from lower reaches 20 of upper belts UB where upper reaches 22 of lower belts LB extend engagingly below and past the bottom sides of rear rollers 110. Downstream from rear rollers 110, accumulator apparatus 10 includes a plurality of lower rollers 120 rotatably attached to a shaft 122 (FIG. 8), and lower belts LB extend around lower rollers 120 so as to reverse direction back toward lower guide rollers 46, as most clearly illustrated in FIGS. 4 and 5 of the drawings. Lower rollers 120 and lower guide rollers 46 of entry roller guides means 40 therefore are the outermost opposing rollers around which lower belts LB extend and cycle. Lower rollers 120 are preferably located and maintained in a further spaced-apart position from lower reaches 20 of upper belts UB than the spacedapart distance of rear rollers 110 of ramp means 80 from lower reaches 20 of upper belts UB.

Sheet articles advancing through accumulator apparatus 10 between upper belts UB and lower belts LB and past nip roller means 60 will therefore contact and be deflected by ramp members 82 and 82A out of the horizontal feeding plane and over upper edges 96. Lower reaches 20 of upper belts UB can also be diverted upwardly by ramp members 82 as will be appreciated by those of skill in the art. Downstream of upper edges 96, a deflected sheet article is urged back toward the horizontal feeding plane by resilient action of lower reaches 20 of upper belts UB due to their tension and/or diversion. Accumulator apparatus 10 can include a plurality of upper rollers 130 attached to shaft 132 above lower reaches 20 of upper belts UB to assist in maintenance of tension of lower reaches 20 of upper belts UB for facilitating resilient action by lower reaches 20 against diverted sheet articles. Progressive seriatim feeding of sheet articles in the horizontal feeding plane where the sheet articles are deflected by ramp members 82 and 82A causes over-accumulation of sheet articles in a stack or accumulation location past upper edges 96 of ramp members 82 and 82A.

To support sheet articles accumulated in the accumulation location, accumulator apparatus 10 comprises support means which can comprise in one embodiment a plurality of spaced-apart supports 98 which can extend from intermediate ramp members 82A. The support means can further comprise additional downstream support means in the form of lower metal supports 140 attached to frame portion 30. As illustrated schematically in FIG. 5, sheet articles advanced past upper edges 96 of ramp members 82 and 82A are accumulated in a stack S which is supported on supports 98 and supports 140.

The leading edges of sheet articles accumulated in stack S are positioned against and stopped by selectively operable stop means generally designated 150 (not shown in FIG. 1) and located downstream from ramp means 80 and stack S. While it is envisioned according to this invention that stop means 150 could comprise any suitable means for selectively stopping and advancing accumulated sheet articles, stop means 150 comprises in a preferred embodiment a plurality of spaced-apart upper stop rollers 152 attached to shaft 154 and a plurality of spaced-apart lower stop rollers 156 (not shown in FIG. 8) attached to shaft 158. In the accumulated position, the trailing edges of the sheet articles in stack S are preferably spaced apart a predetermined distance from vertical edges 92 of ramp members 82 and 82A, although it is envisioned that they could be in contact with vertical edges 92. Stack S is therefore contained between vertical edges 92 and stop means 150.

In accordance with a novel aspect of this invention, upper reaches 22 of lower belts LB are therefore serpentined over and below front rollers 100 and rear rollers 110, respectively. Lower belts LB are thereby spaced-apart from and cannot contact sheet articles accumulated in stack S while they are accumulated and even while stack S is advanced from the accumulation location. Where sheet articles to be processed through accumulator apparatus 10 have toner only on one side thereof, such sheet articles can be processed through accumulator apparatus 10 with the toner side facing down toward lower belts LB to eliminate the possibility of marking of the sheet articles by lower belts LB at any point past upper edges 96 of ramp members 82 and 82A.

A plurality of spaced-apart rollers 160 can also be operably attached to shaft 154 and upper belts UB can extend therearound in an engaging manner so as to reverse direction back toward upper guide rollers 42. Upper stop rollers 152 and lower stop rollers 156 are exit nip rollers adapted for pinching together sheet articles therebetween and can be used for selectively stopping accumulated sheet articles or advancing accumulated sheet articles from accumulator apparatus 10 by pulling the sheet articles between upper stop rollers 152 and lower stop rollers 156.

It can therefore be seen that the present invention provides a novel accumulator apparatus and method. It is also seen that the present invention provides an accumulator apparatus and method which reduces or eliminates marking of sheet articles processed therethrough. Furthermore, it can be appreciated that the present invention provides an accumulator apparatus and method which in some applications eliminates the need for utilization of a cutter interface when the accumulator apparatus is operatively connected downstream of a cutter apparatus.

It will be understood that various details of the invention may be changed without departing from the scope of the invention. Furthermore, the foregoing description is for the purpose of illustration only, and not for the purpose of limitation, as the invention is defined by the following appended claims.

What is claimed is:

1. An accumulator apparatus for accumulating sheet articles, said accumulator apparatus comprising:

(a) upper belt means and lower belt means being at least proximately operative such that sheet articles can be advanced in a seriatim manner between portions thereof in an at least substantially horizontal feeding plane;

(b) a ramp operative for deflecting out of the feeding plane sheet articles advanced between said upper and lower belt means;

(c) an accumulator for over-accumulating in an accumulation location sheet articles deflected by said ramp; and (d) said lower belt means extending away from said upper belt means such that said lower belt means are positioned below and entirely out of contact with accumulated sheet articles in said accumulation location;

(e) whereby sheet articles can be accumulated in and advanced from said accumulation location without being contacted by said lower belt means after sheet articles are in said accumulation location.

2. The accumulator apparatus of claim 1 wherein said ram comprises a plurality of spaced-apart ramp members.

3. The accumulator apparatus of claim 1 wherein said accumulator apparatus further comprises a support extending from said ramp for supporting accumulated sheet articles.

4. The accumulator apparatus of claim 1 wherein said accumulator apparatus further comprises a stop comprising at least one pair of upper and lower exit nip rollers selectively operable to stop advancement of accumulated sheet articles past said accumulation position or to pull accumulated sheet articles from said accumulation position and between said upper and lower exit nip rollers.

5. The accumulator apparatus of claim 1 further comprising downstream from an entrance between said upper belt means and said lower belt means at least one front roller and one downstream rear roller and wherein said lower belt means extends over said front roller and then below said rear roller.

6. The accumulator apparatus of claim 5 wherein said front and rear rollers are part of said ramp.

7. The accumulator apparatus of claim 1 further comprising entry guide rollers at an entrance to said feeding plane for guiding sheet articles into said accumulator apparatus without pinching the sheet articles.

8. The accumulator apparatus of claim 7 wherein said entry guide rollers comprise at least a pair of vertically spaced-apart upper and lower guide rollers with said upper guide rollers having said upper belt means extending therearound and said lower guide rollers having said lower belt means extending therearound.

9. The accumulator apparatus of claim 1 further comprising entry nip rollers disposed upstream of said ramp for pulling leading edges of sheet articles into said accumulator apparatus between said upper and lower belt means.

10. The accumulator apparatus of claim 9 wherein said entry nip rollers comprise at least one pair of upper and lower entry nip rollers.

11. The accumulator apparatus of claim 9 wherein said entry nip rollers are laterally adjustable to accommodate various lengths of sheet articles entering said accumulator apparatus.

12. An accumulator apparatus for accumulating sheet articles, said accumulator apparatus comprising:

(a) upper belt means and lower belt means being at least proximately operative such that sheet articles can be advanced in a seriatim manner between portions thereof in an at least substantially horizontal feeding plane;

(b) entry guide rollers at an entrance to said feeding plane for guiding sheet articles into said accumulator apparatus without pinching the sheet articles, said entry guide rollers comprising at least a pair of vertically spaced-apart upper and lower guide rollers with said upper guide rollers having said upper belt means extending therearound and said lower guide rollers having said lower belt means extending therearound;

(c) entry nip rollers disposed downstream from said entry guide rollers for pulling leading edges of sheet articles into said accumulator apparatus between said upper and lower belt means, said entry nip rollers comprising at least one pair of upper and lower entry nip rollers for pinching sheet articles therebetween;

(d) a ramp disposed downstream from said entry nip rollers and comprising a plurality of ramp members operative for deflecting out of the feeding plane sheet articles advanced between said upper and lower belt means;

(e) an accumulator for over-accumulating in an accumulation location sheet articles deflected by said ramp members, said accumulator comprising a support for supporting accumulated sheet articles and a stop for selectively stopping accumulated sheet articles from advancing further past said accumulation location, said stop comprising at least one pair of upper and lower exit nip rollers selectively operable to stop advancement of accumulated sheet articles past said accumulation position or to pull accumulated sheet articles from said accumulation position and between said upper and lower exit nip rollers; and (f) said lower belt means comprising one or more lower belts, one or more front rollers and one or more downstream rear rollers with said front and rear rollers disposed downstream from said entry nip rollers and wherein said one or more lower belts extend over said front rollers and then below said rear rollers such that said one or more lower belts are positioned below said accumulation location and said support means in a spaced-apart manner;

(g) whereby when sheet articles are accumulated in said accumulation location, said lower belts extend below the accumulated sheet articles without contacting the accumulated sheet articles.

13. The accumulator apparatus of claim 12 wherein said front and rear rollers are part of said ramp.

14. A method of accumulating sheet articles comprising the steps of:

(a) advancing one or more sheet articles in seriatim manner between upper and lower belt means in a substantially horizontal feeding plane where said sheet articles are contacted by said upper and lower belt means;

(b) deflecting said sheet articles while said sheet articles are advanced between said upper and lower belt means; and (c) over-accumulating said deflected sheet articles in an accumulation location wherein further advancement of said accumulated sheet articles from said accumulation location is stopped and wherein said lower belt means is entirely out of contact with any of said sheet articles in said accumulation location.

15. The method of claim 14 wherein the step of paragraph (a) comprises advancing said sheet articles between an initial plurality of guide rollers which guide the sheet articles between said upper and lower belt means without pinching said sheet articles.

16. The method of claim 15 wherein advancing said sheet articles between said guide rollers is accomplished at least in part by pulling said sheet articles with nip rollers located downstream of said guide rollers.

17. The method of claim 15 wherein advancing said sheet articles between said guide rollers further comprises feeding said sheet articles into and between said guide rollers.

18. The method of claim 14 further comprising the step of selectively advancing said accumulated sheet articles from said accumulation location.

19. The method of claim 14 wherein said sheet articles are stopped from further advancement from said accumulation location and selectively advanced therefrom by utilization of nip rollers selectively operable for stopping or advancing said accumulated sheet articles.

20. A method of accumulating sheet articles comprising the steps of:

(a) advancing sheet articles in seriatim manner between upper and lower belt means in a substantially horizontal feeding plane where said sheet articles are contacted by said upper and lower belt means, and wherein said sheet articles are advanced between an initial plurality of guide rollers which guide the sheet articles between said upper and lower belt means without pinching said sheet articles;

(b) pulling said sheet articles between said upper and lower belt means between nip rollers located downstream of said guide rollers;

(c) deflecting said sheet articles while said sheet articles are advanced between said upper and lower belt means downstream from said nip rollers;

(d) over-accumulating said deflected sheet articles in an accumulation location wherein further advancement of said accumulated sheet articles from said accumulation is stopped and wherein said lower belt means is entirely out of contact with any of said sheet articles in said accumulation location; and (e) selectively advancing said accumulated sheet articles from said accumulation location.

21. A method of accumulating sheet articles exiting a cutter apparatus, said method comprising the steps of:

(a) providing an accumulator apparatus comprising:

(i) upper belt means and lower belt means being at least proximately operative such that sheet articles can be advanced in a seriatim manner between portions thereof in an at least substantially horizontal feeding plane;

(ii) a ramp operative for deflecting out of the feeding plane sheet articles advanced between said upper and lower belt means;

(iii) an accumulator for over-accumulating in an accumulation location sheet articles deflected by said ramp, said accumulator comprising supports extending from said ramp for supporting accumulated sheet articles and stop means for selectively stopping accumulated sheet articles from advancing further past the accumulation location; and (iv) said lower belt means extending away from said upper belt means such that said lower belt means are positioned below and entirely out of contact with accumulated sheet articles in said accumulation location;

(v) whereby when sheet articles are accumulated in said accumulation location, said lower belt means extend below the accumulated sheet articles without contacting the accumulated sheet articles;

(b) attaching said accumulator apparatus directly downstream of said cutter apparatus; and (c) over-accumulating sheet articles exiting said cutter apparatus with said accumulator apparatus.

22. An accumulator apparatus for accumulating sheet articles, said accumulator apparatus comprising:

(a) upper belt means and lower belt means being at least proximately operative such that sheet articles can be advanced in a seriatim manner between portions thereof in an at least substantially horizontal feeding plane;

(b) ramp means operative for deflecting out of the feeding plane sheet articles advanced between said upper and lower belt means;

(c) accumulating means for over-accumulating in an accumulation location sheet articles deflected by said ramp means, said accumulating means comprising support means for supporting accumulated sheet articles and stop means for selectively stopping accumulated sheet articles from advancing further past the accumulation location;

(d) said lower belt means extending away from said upper belt means such that said lower belt means are positioned below said accumulation location and said support means in a spaced-apart manner;

(e) said support means for supporting accumulated sheet articles comprising supports extending from said ramp means and said support means further comprising support plates extending downstream from said supports; and (f) whereby when sheet articles are accumulated in said accumulation location, said lower belt means extend below the accumulated sheet articles without contacting the accumulated sheet article.

23. An accumulator apparatus for accumulating sheet articles, said accumulator apparatus comprising:

(a) an upper belt and a lower belt being at least proximately operative such that sheet articles can be advanced in a seriatim manner between portions thereof in an at least substantially horizontal feeding plane;

(b) a ramp operative for deflecting out of the feeding plane sheet articles advanced between said upper belt and said lower belt;

(c) an accumulator for over-accumulating in an accumulation location sheet articles deflected by said ramp, said accumulator comprising a support for supporting accumulated sheet articles in said accumulation location wherein said support extends from said ramp and comprises a support plate extending downstream from said support; and (d) the lower belt extending away from said upper belt such that said lower belt is positioned below and entirely out of contact with said accumulation location and any over-accumulated sheet articles;

(e) whereby sheet articles can be accumulated in and advanced from said accumulation location without being contacted by said lower belt after.

* * * * *